United States Patent [19]

Boehland

[11] 4,277,848

[45] Jul. 14, 1981

[54] COLOR CHANGEABLE ATHLETIC JERSEY

[76] Inventor: Melvin G. Boehland, 3170 Park Overlook Dr., Shoreview, Minn. 55112

[21] Appl. No.: 128,650

[22] Filed: Mar. 10, 1980

[51] Int. Cl.[3] ..... A41B 1/00

[52] U.S. Cl. ..... 2/115

[58] Field of Search ..... 2/115, 108, 94

[56] References Cited

U.S. PATENT DOCUMENTS

| | | | |
|---|---|---|---|
| 1,113,977 | 10/1914 | Freedman | 2/108 |
| 2,685,690 | 8/1954 | Chrisman | 2/1 |
| 4,078,265 | 3/1978 | Condit | 5/115 |

*Primary Examiner*—Doris L. Troutman

*Attorney, Agent, or Firm*—Merchant, Gould, Smith, Edell, Welter & Schmidt

[57] ABSTRACT

An athletic jersey (2) having a body portion (4) of a first color. At least one color changing panel (20) is relatively permanently secured to the outside (10) of body portion (4). Panel (20) is folded over with an upper half (34) covering the lower half (36) to give jersey (2) a uniform color appearance. However, when panel (20) is unfolded and placed in a spread-out condition on body portion (4), the side (22) of panel (20) which is exposed is of a second color different from the color of body portion (4) to effectively change the color of jersey (2).

12 Claims, 6 Drawing Figures

FIG. 4
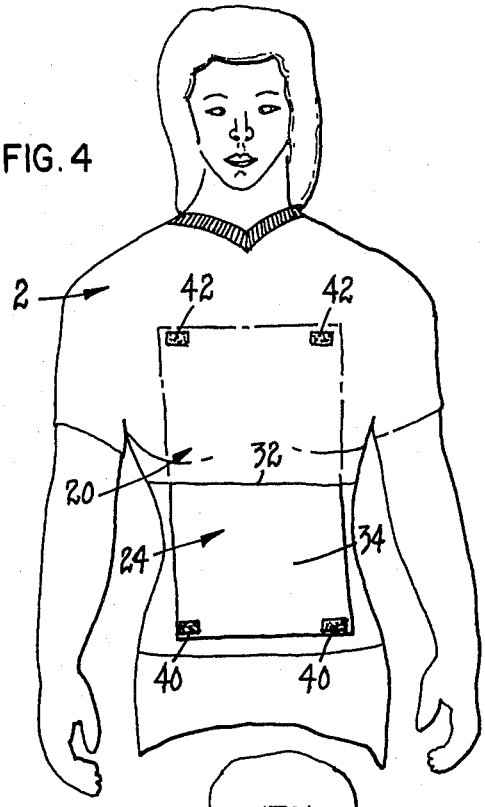
FIG. 5
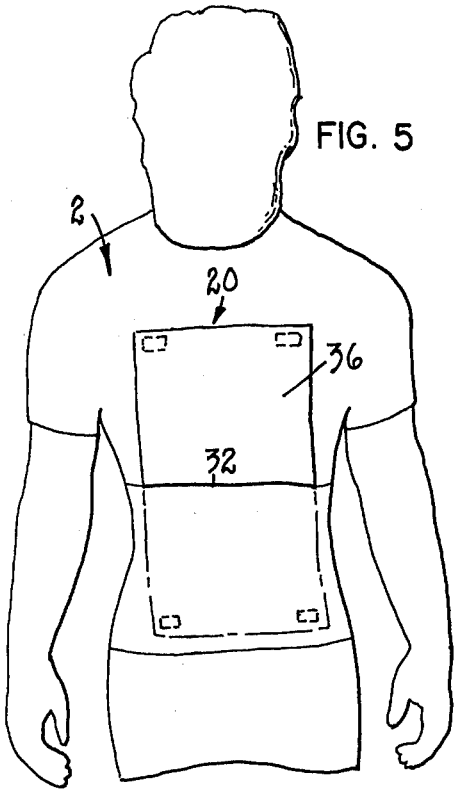
FIG. 3
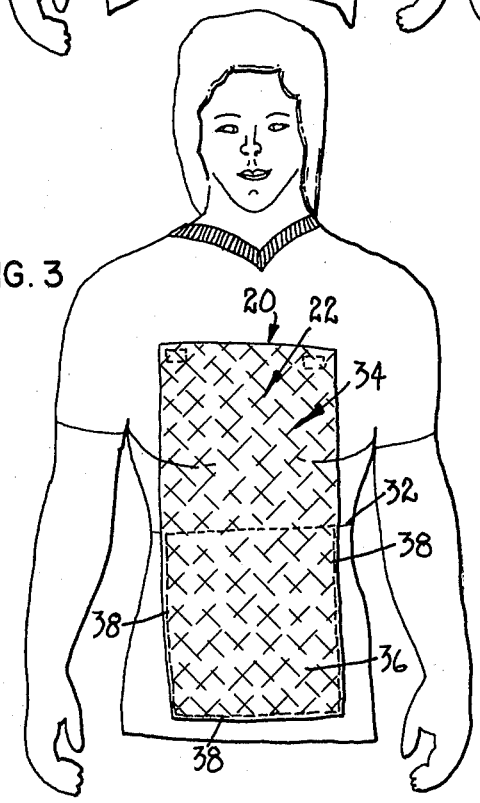
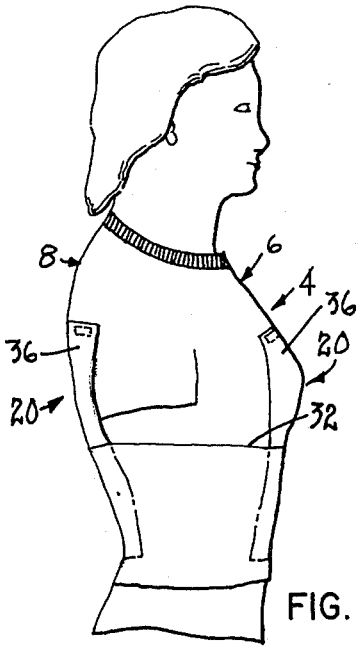
FIG. 6

COLOR CHANGEABLE ATHLETIC JERSEY

TECHNICAL FIELD

This invention relates to an article of apparel, i.e. clothing. More specifically, this invention relates to an athletic jersey having means for easily changing the color of the jersey. As such, this invention has wide utility in any sport requiring a color changeable jersey.

DESCRIPTION OF THE PRIOR ART

Many sports are played having two teams each of which includes an equal number of players. The majority of these so called "team sports", e.g. basketball, hockey, soccer, football, etc., require that both teams be on the field of play simultaneously. Therefore, it is important that the members of one team be able to differentiate themselves from the members of the opposing team. A common method of accomplishing this is to require the two teams to wear differently colored uniforms.

While differently colored uniforms are acceptable during the course of formal athletic competition between two teams, it is generally too expensive for a team to use differently colored uniforms during practice. Nonetheless, practice still poses the same problem of differentiating one squad of players from the other. One solution to this problem has been the use of an athletic jersey which is reversible and differently colored on the inside than it is on the outside. Thus, one team only has to wear its jersey inside out in order to tell its members apart from the members of the other team.

While the use of reversible jerseys is generally acceptable for male athletes, the same is generally not true for female athletes. It is not practical for female athletes to remove and reverse their jerseys when in public view. Accordingly, female athletes have to go to their locker room to accomplish any desired jersey change. This is inconvenient since it disrupts the practice session. In addition, if the locker room is located very far from the field of play as might be the case, it also detracts from the amount of practice time. Accordingly, the use of reversible jerseys for female athletes is disadvantageous.

Female athletes have for a number of years used what is known as "pennys" to selectively change the color of their jerseys during practice. A penny is nothing more than an auxiliary shirt or jersey which may be slipped over the regular jersey of the female athlete without removing the regular jersey. Since the penny is generally colored differently than the regular jersey, a color change is effected whenever the penny is slipped on. However, many female athletes dislike using a penny since it is, in effect, a second jersey worn over the top of the first. Some female athletes find this confining and uncomfortable.

SUMMARY OF THE INVENTION

Accordingly, one aspect of this invention relates to an athletic jersey which can effect a color change without the user having to remove and reverse the jersey and without having to add an auxiliary jersey. As such a jersey acccording to this invention is particularly suited for female athletes although it is not limited for use with female athletes.

An athletic jersey according to this invention comprises a body portion having an inside and an outside.

The outside of the body portion is generally of a uniform first color. A color changing panel is secured to the outside of the body portion which panel is of a second color different from the first color. A means is provided for selectively covering or uncovering the color changing panel without having to remove or reverse the jersey. The color changing panel is of sufficient size in relation to the body portion such that the jersey appears to be primarily of the second color when the panel is selectively uncovered.

BRIEF DESCRIPTION OF THE DRAWINGS

This invention will be described in more detail in the following Detailed Description, when taken in conjunction with the following drawings, in which like reference numerals refer to like elements throughout.

FIG. 3 is a front plan view of an athletic jersey shown in FIG. 1, illustrated in place on a female athlete with the color changing panel being selectively uncovered;

FIG. 4 is a front plan view of an athletic jersey shown in FIG. 1, illustrated in place on a female athlete with the color changing panel being selectively covered;

FIG. 5 is a front plan view of an athletic jersey according to a second embodiment of this invention; and FIG. 6 is a side plan view of the second embodiment of the athletic jersey shown in FIG. 5.

DETAILED DESCRIPTION

Figure 1:
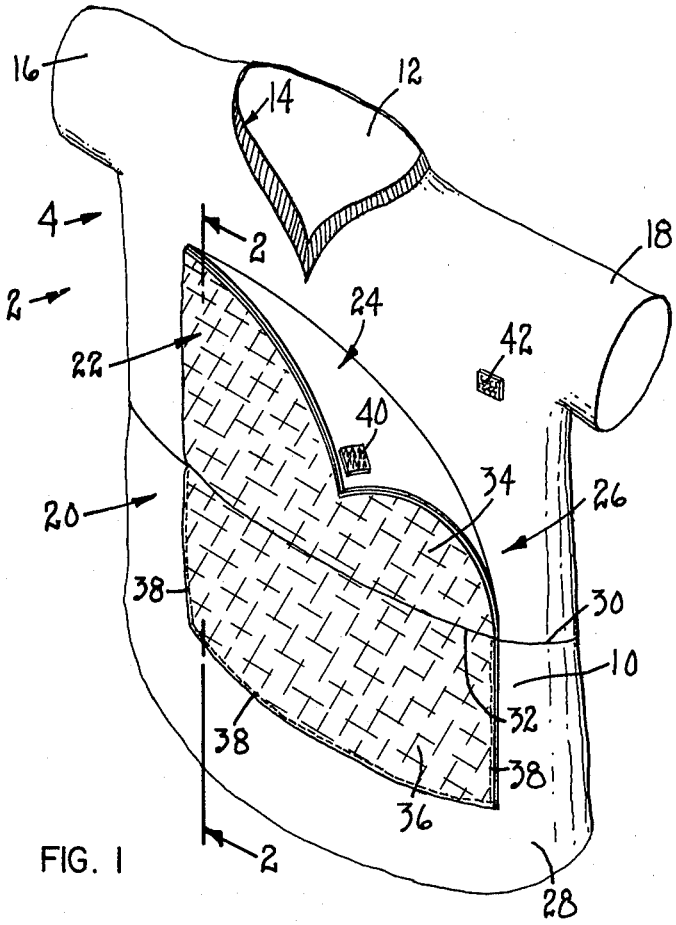
FIG. 1 is a perspective view of a first embodiment of an athletic jersey according to this invention.

Referring first to FIG. 1, an athletic jersey according to this invention is illustrated as 2. Jersey 2 includes a torso encircling body portion 4. Body portion 4 has a front 6 and a back 8 normally located on the front and back of the person wearing the jersey. See FIG. 6. Moreover, jersey 2 has an outside 10 and an inside 12 which refer, respectively, to those surfaces of the jersey which are exterior to the skin of the person wearing the jersey and which are proximate to the skin of the person wearing the jersey. In addition to body portion 4, jersey 2 includes a neck hole 14 through which the head of the wearer extends and arms or sleeves 16 and 18. Jersey 2 could be formed without distinct sleeves 16 and 18 if so desired.

A first color changing panel illustrated as 20 is secured to the front 6 of jersey 2. Color changing panel 20 is rectangular and also includes a front side 22 and a back side 24. The back side 24 of panel 20 is defined by a first planar piece of material which is of the same color as that of the color of the body portion of the jersey, i.e. a uniform first color of any choice. The front side 22 of panel 20 is defined by a second planar piece of material of the same size as the first piece and integrally secured to the first piece as by sewing. However, the second piece of material which defines the front side 22 of panel 20 is made from a second color which is different from the first color. Preferably, this second color will be a color which sharply contrasts with the first color.

Color changing panel 20 is secured to jersey 2 in a novel manner. First, the torso encircling body portion 4 of jersey 2 includes a torso encircling upper half 26 and a torso encircling lower half 28 which are fixedly sewn together along a substantially horizontal circumferential seam 30. Panel 20 is mounted to the front 6 of jersey 2 by folding the panel 20 in half along a fold line 32. With the back side of panel 20 being located adjacent the front 6 of jersey 2 (i.e., facing the front 6), the fold line 32 of panel 20 is then inserted in the seam 30 between the upper and lower halves 26 and 28 of body portion 4 before that seam 30 is sewn. Then, the same line 31 of stitching which forms seam 30 also anchors and secures the color changing panel 20 to body portion 4.

Color changing panel 20 includes a top or upper half 34 above fold line 32 and a bottom or lower half 36 below fold line 32. In the embodiment of jersey 2 shown in FIGS. 1–4, lower half 36 of panel 20 is fixedly secured to the body portion 4 of jersey 2 by a line 38 of stitching which extends around the periphery of lower half 36. However, the upper half 34 is not permanently secured to body portion 4 at all, but is instead pivotal relative thereto by virtue of the placement of fold line 32 in the seam 30 of jersey 2. This allows upper half 34 to fold down over and cover or hide lower half 36 while being movable to a spread-out position on body portion 4 where upper half 34 does not cover lower half 36.

Adjacent each upper corner on the back side of upper half 34 of panel 20 is a first portion 40 of a generally conventional hook and pile fastener. The other portion 42 of the hook and pile fastener is fixedly secured to body portion 4 of jersey 2 at a location which will engage with that portion 40 of the fastener when upper half 34 of panel 20 is in a spreadout formation on the body portion 4 of jersey 2. For example, the hook part of the fastener could be located on the back side of panel 20 while the pile part of the fastener is located on the body portion 4 of jersey 2 or vice versa. Such a hook and pile fastener is generally known as a Velcro ® fastener.

In the operation of this invention, an identical color changing panel 20 is preferably used on both the front 6 and back 8 of jersey 2. See FIG. 6. When these color changing panels 20 are placed into a condition in which they are folded over with the upper half 34 covering the lower half 36, then jersey 20 appears to be all of a substantially uniform first color. See FIG. 4. The pivotal upper half 34 of panel 20 simply hangs by gravity down over the lower half 36 with the back side 24 of the upper half 34 being outermost and visible to the eye. Since the back side 24 of panel 20 is the same color as body portion 4 of jersey 2, the color changing panel 20 in this configuration blends in with the color of body portion 4. Hence, jersey 2 appears to be of the first color.

When it is desired to change the color of jersey 2, the panel is unfolded from the configuration shown in FIG. 4 and placed into the spread-out configuration shown in FIG. 3. In this configuration, the upper half 34 of panel 20 is releasably secured by the hook and pile fasteners to the upper half 26 of body portion 4 of jersey 2. This is done for both color changing panels 20 on the front and back of jersey 2. In the spread-out configuration of FIG. 3, the front side 22 of panel 20 is now visible to the eye. This side is of the second color rather than the first color. Thus, any member of the team can easily change the color of his or her jersey from the first to the second color simply by unfolding the color changing panels 20 and releasably securing them in the spread-out configuration of FIG. 3.

Jersey 2 according to this invention is particularly suited for female athletes for whom reversible jerseys are not practical and who often dislike the added confinement of the "penny" type jersey. Such female athletes are thus not encumbered by an additional auxiliary jersey and only have to unfold and secure the color changing panels 20 in their spread-out configuration to change the color of their jerseys. This can be easily and quickly done on the field of play. However, jersey 2 is not limited for use with female athletes, but is usable equally as well with male athletes.

Another embodiment of the jersey according to this invention will be illustrated in FIGS. 5 and 6. In this embodiment, the color changing panels 20 and the elements of the jersey which are the same as those elements in the embodiment of FIGS. 1–4 will be referred to by the same reference numerals. Color changing panels 20 are virtually identical in all respects to the panels shown in FIGS. 1–4. In other words, a color changing panel 20 is located on both the front 6 and back 8 of jersey 2 and can be placed in either a folded up or spread-out condition. In the folded up condition, the visible part of panel 2 blends in with that of the jersey 2. However, in the spread-out condition, the visible part of panel 2- contrasts with the first color of jersey 2 to effectively change the color of jersey 2.

The primary difference in the embodiment of FIGS. 5 and 6 is that the upper half 34 of the panel is fixedly sewn along lines 38 on the top half 26 of body portion 4 rather than lower half 28. Thus, the lower half 36 of panel 20 is now the pivotal half and normally hangs down simply by virtue of gravity in the spread-out position. In this embodiment, the hook and pile fasteners 40 and 42 are now located on the front side 22 of lower half 36 and upper half 34 of panel 20 such that they engage one another when the upper and lower halves 34 and 36 are folded over. Thus, the releasable interengaging means defined by the hook and pile fastener is effective to hold the panel 20 in its folded up configuration rather than in its spread-out configuration. When the fasteners 40 and 42 are released, the lower half 36 of panel 20 will simply hang by gravity down below upper half 34 to reverse the apparent color of jersey 2. However, additional hook and pile fasteners could also be used between the lower half 36 of the color changing panel 26 and the lower half 28 of body portion 4 of the jersey to releasably hold panel 20 in its spread-out orientation rather than rely merely on the force of gravity to keep the panel 20 spread out.

Figure 2:
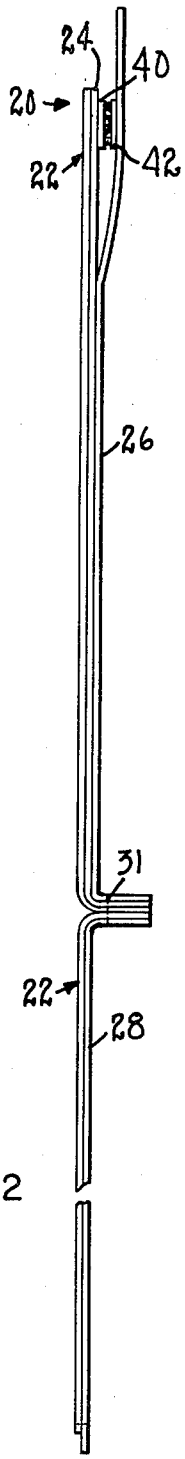
FIG. 2 is a cross-sectional view of the athletic jersey shown in FIG. 1, taken along lines 2—2 in FIG. 1.

Various other modifications of this invention will be apparent to those skilled in the art. For example, instead of two separate color changing panels 20 on both the front and rear sides of the jersey, a single torso encircling color changing panel might possibly be used. Both the athletic jersey and the color changing panels may be made from any suitable flexible materials; fabric type materials are generally preferred. In addition, panels 20 need not necessarily be of the double layer construction made from first and second pieces of material of generally the same size sewn together. Instead, a single piece of material of the same color as that of the jersey could be used with one side of the piece of material having the appropriate second color printed or otherwise sprayed thereupon. Another embodiment illustrated in FIGS. 1 and 2 is to make the top half 34 of panel 20 from the double layer construction with the lower half 36 being of a single layer construction. In this event, the back side 24 of panel 20 extends only over the upper half 34 of panel 20 and not over the entire panel. Furthermore, fold line 32 could be arranged on body portion 4 to be either horizontal as shown, angled across body portion 4, or even vertical. Accordingly, this invention is not to be limited by the preceeding description of the preferred embodiment. Instead, the scope of protection is to be limited only by the appended claims.

I claim:

1. An athletic jersey, which comprises:

(a) a body portion having an inside and an outside with the outside being of a substantially uniform first color, wherein the body portion of the jersey includes front and back sides;

(b) a color changing panel on each of the front and back sides of the body portion each of the panels being of a second color different from the first color;

(c) means for selectively covering and uncovering the color changing panels without turning the body portion of the jersey inside out; and (d) wherein the color changing panels are of sufficient size in relation to the body portion of the jersey such that the jersey appears to be generally of the second color rather than the first color when the color changing panels are uncovered.

2. An athletic jersey, which comprises:

(a) a body portion having an inside and an outside with the outside being of a substantially uniform first color;

(b) a color changing panel secured to the outside of the body portion and being of a second color different from the first color;

(c) means for selectively covering and uncovering the color changing panel without turning the body portion of the jersey inside out, wherein the means for selectively covering and uncovering comprises a first portion of the color changing panel which is suited to be folded over to cover the remaining portion of the color changing panel and which can be unfolded therefrom to cause the color changing panel to be uncovered; and (d) wherein the color changing panel is of sufficient size in relation to the body portion of the jersey such that the jersey appears to be generally of the second color rather than the first color when the color changing panel is uncovered.

3. An athletic jersey as recited in claim 2, wherein the first portion of the color changing panel includes means for releasably fixing the first portion to the body portion of the jersey at a distal location from the remaining portion of the panel so that the panel may be held in a spread out configuration of the body portion.

4. An athletic jersey as recited in claim 3, wherein the releasable engaging means comprises a hook and pile fastener.

5. An athletic jersey as recited in claim 2, wherein the color changing panel includes front and back sides and is folded in half along a fold line to define first and second halves that respectively form the first and remaining portions of the panel.

6. An athletic jersey as recited in claim 5, wherein the front side of the color changing panel is of the second color and the back side of the panel is of the first color, and wherein the panel is secured to the body portion of the jersey with the back side of the panel being located adjacent the body portion of the jersey.

7. An athletic jersey as recited in claim 5, wherein the fold line is substantially horizontal.

8. An athletic jersey as recited in claims 5 or 6, wherein the second half of the color changing panel is fixedly secured to the body portion and the first half of the panel is pivotal relative to the second half so that it can be folded over the second half and cover the second half with the back side of the first half of the panel being located exteriorly when the first half is folded over.

9. An athletic jersey as recited in claim 8, wherein the fold line is substantially horizontal, and wherein the fixed half is the lower half of the panel and the pivotal half is the upper half of the panel which upper half merely hangs down and covers the lower half.

10. An athletic jersey as recited in claim 9, wherein the back side of the upper half of the panel includes means for releasably securing the upper half of the panel to the body portion of the jersey when the upper half is unfolded.

11. An athletic jersey as recited in claim 8, wherein the fold line is substantially horizontal, and wherein the upper half of the panel is the fixed half and the lower half of the panel is the pivotal half of the panel, and wherein the lower half includes means for releasably securing the lower half to the upper half in the folded over position of the panel.

12. An athletic jersey as recited in claim 2, wherein the body portion comprises a torso encircling upper portion and a torso encircling lower portion sewn together along a horizontal seam extending around the circumference of the jersey, and wherein the color changing panel is folded over along a line which is sewn into the seam of the jersey for firmly anchoring the color changing panel to the body portion.

* * * * *